US011725485B2

(12) United States Patent
Steele et al.

(10) Patent No.: US 11,725,485 B2
(45) Date of Patent: Aug. 15, 2023

(54) CONCENTRIC TUBING STRINGS AND/OR STACKED CONTROL VALVES FOR MULTILATERAL WELL SYSTEM CONTROL

(71) Applicant: Halliburton Energy Services, Inc., Houston, TX (US)

(72) Inventors: David Joe Steele, Carrollton, TX (US); Justin Mark Roberts, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/224,792

(22) Filed: Apr. 7, 2021

(65) Prior Publication Data

US 2021/0310336 A1 Oct. 7, 2021

Related U.S. Application Data

(60) Provisional application No. 63/006,557, filed on Apr. 7, 2020.

(51) Int. Cl.

| | |
|---|---|
| ***E21B 41/00*** | (2006.01) |
| ***E21B 34/16*** | (2006.01) |
| ***E21B 34/08*** | (2006.01) |

(52) U.S. Cl.

CPC ..... *E21B 41/0035* (2013.01); *E21B 34/08* (2013.01); *E21B 34/16* (2013.01)

(58) Field of Classification Search

CPC ..... E21B 41/0035; E21B 34/16; E21B 34/08

See application file for complete search history.

(56) References Cited

U.S. PATENT DOCUMENTS

| | | | |
|---|---|---|---|
| 2,905,099 | A | 9/1959 | Turner |
| 2,963,089 | A | 12/1960 | Sizer |

(Continued)

FOREIGN PATENT DOCUMENTS

| | | | |
|---|---|---|---|
| AU | 5991801 | A | 4/2002 |
| CN | 106150433 | A | 11/2016 |

(Continued)

OTHER PUBLICATIONS

Schlumberger, "TRFC-HS, Dual-line multiposition flow control valve," 2019, 2 pages, https://www.slb.com/-/media/files/co/product-sheet/trfc-hd-ps.ashx.

(Continued)

*Primary Examiner* — Nicole Coy

(74) *Attorney, Agent, or Firm* — Scott Richardson; Parker Justiss, P.C.

(57) ABSTRACT

Provided is a completion string and a multilateral well system. The completion string, in one aspect, includes a first tubing string, the first tubing string defining a first fluid path operable to receive a first fluid obtained from a first wellbore. The completion string, in accordance with this aspect, further includes a second tubing string positioned about the first tubing string, the first tubing string and the second tubing string creating an inner annulus that defines a second fluid path operable to receive a second fluid obtained from a second lateral wellbore. The completion string, in accordance with this aspect, further includes a third tubing string positioned about the second tubing string, the second tubing string and the third tubing string defining an outer annulus that defines a third fluid path operable to receive a third fluid obtained from a third lateral wellbore.

27 Claims, 16 Drawing Sheets

(56) References Cited

U.S. PATENT DOCUMENTS

| | | | | |
|---|---|---|---|---|
| 3,282,341 | A | 11/1966 | Hodges | |
| 4,651,969 | A | 3/1987 | Dowdall | |
| 4,771,807 | A | 9/1988 | Karani | |
| 4,896,722 | A | 1/1990 | Upchurch | |
| 5,147,559 | A | 9/1992 | Brophey et al. | |
| 5,355,960 | A | 10/1994 | Schultz et al. | |
| 5,547,029 | A | 8/1996 | Rubbo et al. | |
| 5,597,042 | A | 1/1997 | Tubel et al. | |
| 6,179,052 | B1 | 1/2001 | Purkis et al. | |
| 6,227,298 | B1 | 5/2001 | Patel | |
| 6,302,216 | B1 | 10/2001 | Patel | |
| 6,470,970 | B1 | 10/2002 | Purkis et al. | |
| 6,561,277 | B2 | 5/2003 | Algeroy et al. | |
| 6,575,237 | B2 | 6/2003 | Purkis et al. | |
| 6,923,275 | B2 * | 8/2005 | Gardes | E21B 43/006 166/50 |
| 7,243,738 | B2 * | 7/2007 | Gardes | E21B 41/0035 166/50 |
| 7,370,705 | B2 | 5/2008 | Jones et al. | |
| 8,517,113 | B2 | 8/2013 | Sheffield | |
| 8,776,899 | B2 * | 7/2014 | Fripp | E21B 33/124 166/194 |
| 9,051,798 | B2 | 6/2015 | Crow et al. | |
| 9,784,884 | B2 | 10/2017 | Quintero | |
| 9,816,360 | B2 | 11/2017 | Crow et al. | |
| 10,590,741 | B2 | 3/2020 | Van Der Veen et al. | |
| 2002/0050358 | A1 | 5/2002 | Algeroy et al. | |
| 2003/0066649 | A1 * | 4/2003 | Koot | E21B 43/14 166/250.15 |
| 2003/0221834 | A1 | 12/2003 | Hess et al. | |
| 2004/0173350 | A1 | 9/2004 | Wetzel et al. | |
| 2005/0061511 | A1 | 3/2005 | Steele | |
| 2006/0131030 | A1 | 6/2006 | Sheffield | |
| 2014/0083683 | A1 * | 3/2014 | Tips | E21B 47/00 166/387 |
| 2015/0275645 | A1 | 10/2015 | Gill | |
| 2016/0265314 | A1 | 9/2016 | Saurer | |
| 2017/0002625 | A1 | 1/2017 | Chochua et al. | |

FOREIGN PATENT DOCUMENTS

| | | | | |
|---|---|---|---|---|
| CN | 108535732 | A | 9/2018 | |
| CN | 108798618 | A | 11/2018 | |
| CN | 109815595 | A | 5/2019 | |
| CN | 209228343 | U | 8/2019 | |
| CN | 110500071 | A | 11/2019 | |
| EP | 2350699 | B1 | 4/2019 | |
| WO | 2017004285 | A1 | 1/2017 | |
| WO | WO-2019059885 | A1 * | 3/2019 | E21B 41/0035 |
| WO | 2019063972 | A1 | 4/2019 | |

OTHER PUBLICATIONS

Schlumberger, "Lukoil Saves USD 6.8 Million Using First Extended-Reach Intelligent TAML 5 Multilateral Well," Case Study, 2 pages, 2016, https://www.slb.com/resource-library/case-study/co/extended-reach-intelligent-taml-5-multilateral-cs.

* cited by examiner

| | Larger Diameter (in) | Smaller Diameter (in) | Flow Area (in^2) | % Flow wrt to 2-7/8, 6.40# | Max Seawater Flowrate in BPD allowable per API RP 14E for 13Cr | Comments |
|---|---|---|---|---|---|---|
| 2-7/8, 6.40# Tubing | | 2.441 | 4.7 | 100% | 14,734 | Baseline = 100% Flow |
| 2-7/8 ICV Valve<br>Flow from below Lower Junction<br>(e.g. Mainbore Production) | | | | | | |
| 3-1/2, 9.2# ID | | 2.992 | 7.0 | 150% | 22,137 | Seal Off Lwr MB Stinger<br>5-1/2" 17#, X 3-1/2, 9.2# Annulus |
| 2-7/8, 6.40# Tubing | | 2.441 | 4.7 | 100% | 14,734 | |
| 3-1/2 ICV Valve<br>Flow from Lateral Leg of Lower Junction | | | | | | |
| 4-1/2, 12.6#<br>X<br>2-7/8, 6.40# FJ OD | 3.958 | 2.875 | 5.8 | 124% | 18,255 | |
| Past Lowest ICV | 6.174 | 5.580 | 5.5 | 117% | 17,317 | Seal Off Upper MB Stinger<br>5-1/2" 17# X 4-1/2, 12.6# Annulus |
| 5-1/2 ICV Valve<br>Flow from Lateral Leg of Upper Junction | | | | | | |
| Upper Liner Hanger 6" ID<br>X<br>4-1/2, 12.6# OD | 6.000 | 4.500 | 12.4 | 264% | 39,042 | 7.00" 29.00# (6.174") X 5.580" |
| 9-5/8, 53.5#<br>X<br>7.00" 29.00# FJ | 8.500 | 7.000 | 18.3 | 390% | 57,618 | |
| Past Middle ICV | 8.500 | 7.043 | 17.8 | 380% | 56,044 | Seal Off Upper MB Stinger<br>5-1/2" 17# X 4-1/2, 12.6# Annulus |

FIG. 9

CONCENTRIC TUBING STRINGS AND/OR STACKED CONTROL VALVES FOR MULTILATERAL WELL SYSTEM CONTROL

CROSS-REFERENCE TO RELATED APPLICATION

This application claims the benefit of U.S. Provisional Application Ser. No. 63/006,557, filed on Apr. 7, 2020, entitled "CONCENTRIC TUBING STRINGS AND/OR STACKED CONTROL VALVES FOR MULTILATERAL WELL CONTROL," commonly assigned with this application and incorporated herein by reference in its entirety.

BACKGROUND

The unconventional market is very competitive. The market is trending towards longer horizontal wells to increase reservoir contact. Multilateral wellbores offer an alternative approach to maximize reservoir contact. Multilateral wellbores include one or more lateral wellbores extending from another wellbore (e.g., main wellbore in one instance).

BRIEF DESCRIPTION

Reference is now made to the following descriptions taken in conjunction with the accompanying drawings, in which:

FIG. 9 illustrates flow rates that may be obtained using a multilateral well system designed, manufactured and operated according to one embodiment of the disclosure;

DETAILED DESCRIPTION

Figure 1:
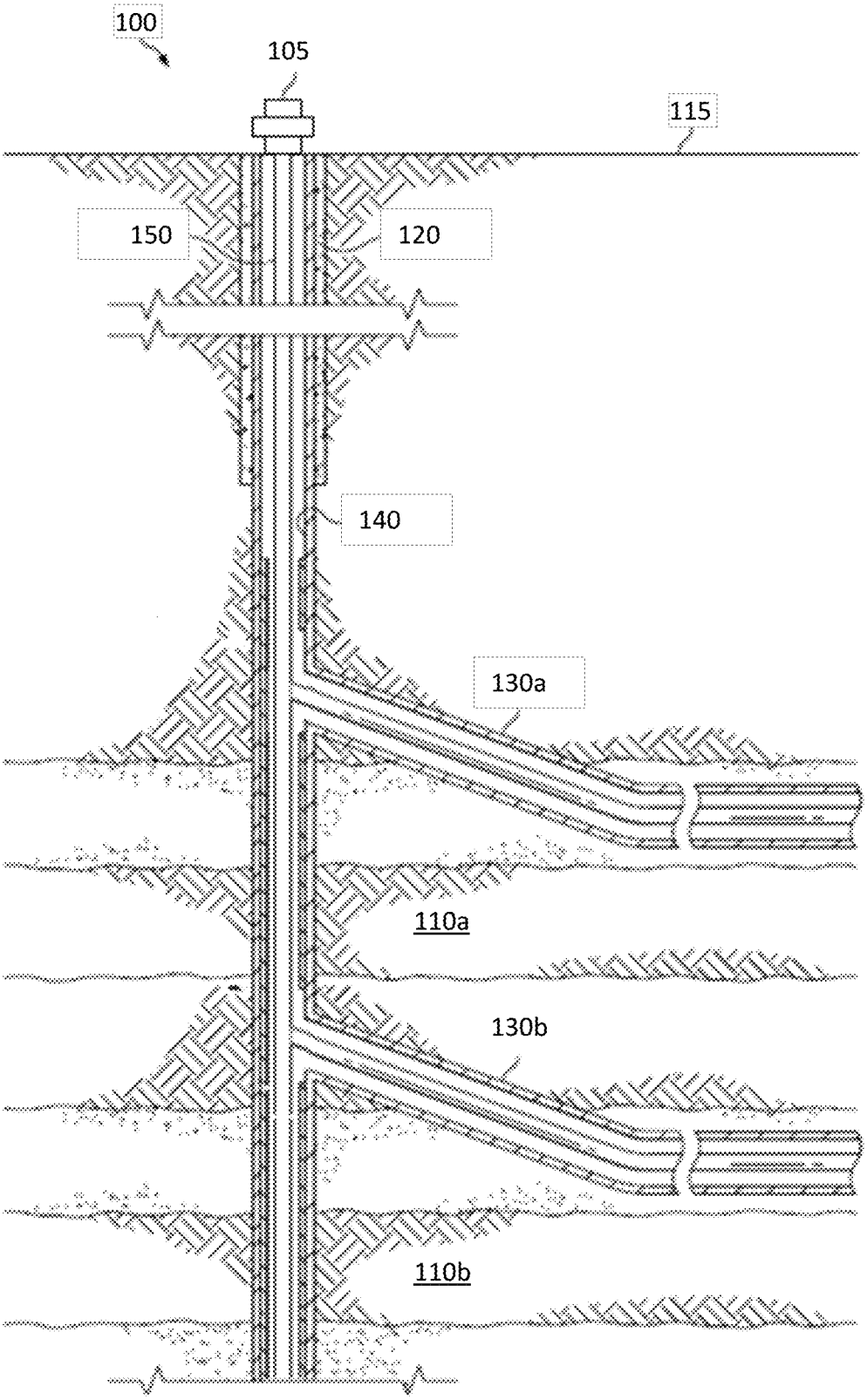
FIG. 1 illustrates a multilateral well system designed, manufactured and operated according to one or more embodiments disclosed herein

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

The current 9⅝" MIC (e.g., Level-5) junction allows for one 2⅞" tubing string through one or more junctions. The downside to this is that the flow through the 2⅞" tubing is limited to less than 17,000 barrels of oil per day according to *API RP* 14*E—Recommended Practice for Design and Installation of Offshore Production Platform Piping Systems* (e.g., for 13Cr tubulars). Accordingly, a multilateral well system using the current 9⅝" MIC junctions would be limited to less than 17,000 barrels of oil per day amongst all of the lateral wellbores. A completion string according to one embodiment of the disclosure employs concentric tubing strings to allow flow to be produced from the lower laterals to individual flow control devices (e.g., stacked flow control devices in certain embodiments), for example located above the upper most lateral wellbore junction.

For example, a completion string according to one embodiment of the disclosure allows for controlling flow from more than one "location" (e.g. lateral, zone, segment of a reservoir, stranded reservoir, two different reservoirs, any place one experienced in the art would apply the concept(s)). A completion string according to one embodiment of the disclosure additionally provides more than one flow path in order to, at least, increase the flow area for the flow of fluids. A completion string according to one embodiment of the disclosure additionally allows one to control the flow, limit the flow, optimize the flow, of more than one flow path by placing flow control devices in a "stacked" configuration—for example one located axially proximate to one or more other flow control devices. A completion string according to one embodiment of the disclosure additionally includes other devices, such as, but not limited to, pressure gauges, temperature gauges, flow gauges, gas/oil monitors, AICDs, ICD, other flow control, flow monitoring, sand monitoring, intelligent equipment, machine-learning equipment and tools.

Turning to FIG. 9, illustrated are flow rates that may be obtained by providing multiple (e.g., three) separate flow paths to the control valves in accordance with the disclosure. As can be seen in FIG. 9, if a single 2⅞" tubing string was used, the maximum flow rate for all 3 laterals, would be limited to less than 15,000 barrels per day (e.g., 14,734 barrels per day). However, using a completion string according to the present disclosure, the following production rates are possible:

Lower Mainbore: 14,734 BPD

Middle Lateral: 17,316 BPD

Combined Flow through of Lower Mainbore and Middle Lateral thru 3½" ICV:

13Cr version: 22,137 BPD

Inconel 718 version: 39,846 BPD

Upper Lateral: 39,041 BPD

Combined Flow through of Lower Mainbore, Middle and Upper Lateral thru 5½" ICV:

13Cr version: 51,636 BPD

Inconel 718 version: 82,945 BPD

Optionally, in accordance with the disclosure, rather than running "skinny" 2⅞" tubing into the wells (e.g., because the wells are extended reach wells with high deviations and the likelihood of buckling the "skinny" tubing is a high-risk) 3½" tubing may be used. Furthermore, a completion string according to the disclosure does not require control lines to be run/exposed below the upper flow control device. Furthermore, by setting a plug below the lowest most flow control device, the plug can be pulled and coiled tubing can be run down into the lowest lateral (main well bore). Additionally, downhole gauges could be run to the lower laterals/mainbore by running an "armored" cable—most-likely it would have to be in one of the flow paths—and/or cross through one of the flow paths in one or more places. Moreover, one or more 2⅞" valves (or similar size valves) could be run below the upper most junction. Such a situation might require smaller OD's to pass through the MIC (or other-type) junction. In other scenarios, wherein one is okay with running some 2⅞" valves and equipment, the completion string could be configured to run 2⅞" flow control devices and equipment down through one or more junctions—optionally through two or more junctions—and then have a concentric string above the middle junction—leading to a 3½" flow control device above the upper most junction.

In addition, power and communication technologies of all types may be used with a completion string according to the disclosure. Certain such technologies are:

Electrical Potential Energy. A cell is a store of electrical 'potential' energy in the form of positive and negative charges, which attract. A flow of electrons through a resistor can transfer electrical potential energy into heat energy.

Sound Energy. Sound waves are pulses of kinetic energy transferred from one place to another by vibrating particles as they bump into their neighbors. Sound energy can travel through a gas, liquid or solid.

Nuclear Energy. A great deal of energy is stored within the nucleus of atoms. This can be released when a nucleus is split into two, or when two light nuclei fuse into a single nucleus. Nuclear power stations are powered by this energy.

Kinetic Energy. Every object that moves has this type of energy. The greater the object's speed, then the greater its kinetic energy. Mass is also important here—a more massive object will also have a greater kinetic energy.

Light. Visible light is a type of electro-magnetic radiation, which travels as waves. The members of this 'E-M' wave family include gamma, x-ray, ultra-violet, visible light, infrared, microwaves and radio waves.

Heat Energy. Heat energy can move from one place to another via conduction, convection and radiation. Another name for this type of energy is 'Thermal Energy'.

Gravitational Potential Energy. Any object that is raised above the ground gains in gravitational potential energy. If the object falls, then this energy is converted into kinetic energy as it falls.

Chemical Potential Energy. Another type of energy that can be stored easily. Examples include chemical potential energy in your muscles, etc.

Elastic Potential Energy. When you stretch or compress a spring, you are storing energy in the bonds between the spring's metal atoms.

Turning to FIG. 1, illustrated is a multilateral well system 100 designed, manufactured and operated according to one or more embodiments disclosed herein. The multilateral well system 100 includes a wellhead 105 positioned over one or more oil and gas formations 110*a*, 110*b* located below the earth's surface 115. Although a land-based wellhead 105 is illustrated in FIG. 1, the scope of this disclosure is not thereby limited, and thus could potentially apply to offshore applications. The teachings of this disclosure may also be applied to other land-based oil and gas systems and/or offshore oil and gas systems different from that illustrated.

As shown, a wellbore 120 has been drilled through the various earth strata, including the formations 110*a*, 110*b*. In the illustrated embodiment, the wellbore 120 is a main wellbore. The term "main" wellbore is used herein to designate a wellbore from which another wellbore is drilled. It is to be noted, however, that a main wellbore does not necessarily extend directly to the earth's surface, but could instead be a branch of yet another wellbore. The multilateral well system 100 additionally includes one or more lateral wellbores 130*a*, 130*b*. In the illustrated embodiment, the one or more lateral wellbores 130*a*, 130*b* extend from the wellbore 120 (e.g., main wellbore) extending therefrom. The term "lateral" wellbore is used herein to designate a wellbore that is drilled outwardly from its intersection with another wellbore, such as a main wellbore. Moreover, a lateral wellbore may have another lateral wellbore drilled outwardly therefrom. Accordingly, a main wellbore may also be a lateral wellbore, and a lateral wellbore may also be a main wellbore. While only two lateral wellbores 130*a*, 130*b* are illustrated in FIG. 1, certain embodiments may employ more than just two lateral wellbores. For example, if the wellbore casing were to be 10¾" casing, as opposed to the typical 9⅝" casing, the multilateral well system 100 might accommodate a third lateral wellbore (not shown). Additionally, if the smallest downhole tubing diameter were to be 3½" tubing, as opposed to the typical 2⅞" tubing, the multilateral well system 100 might again accommodate a third lateral wellbore (not shown), and possibly a fourth lateral wellbore if combined with the aforementioned larger casing diameter.

One or more casing strings 140 may be at least partially cemented within the wellbore 120, and optionally contained within the one or more lateral wellbores 130*a*, 130*b*. The term "casing" is used herein to designate a tubular string used to line a wellbore. Casing may actually be of the type known to those skilled in the art as "liner" and may be made of any material, such as steel or composite material and may be segmented or continuous, such as coiled tubing. A completion string 150 according to the present disclosure may be positioned in the main wellbore 120, for example above a junction between the wellbore 120 and the uppermost lateral wellbore 130*a*.

Figure 2A:
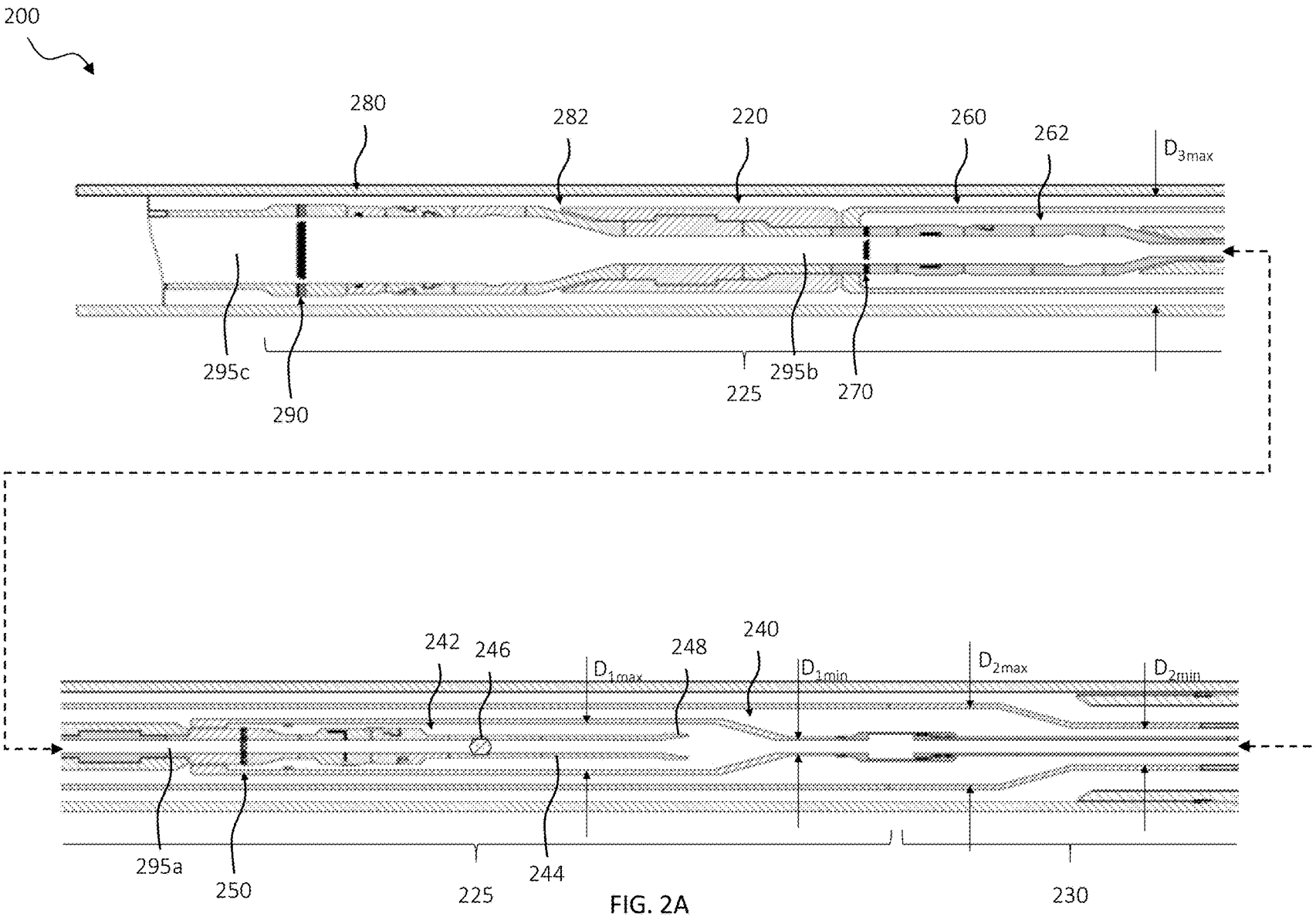
FIGS. 2A and 2B illustrate a multilateral well system including a completion string designed, manufactured, installed and operated according to one or more embodiments of the disclosure.
Figure 2B:
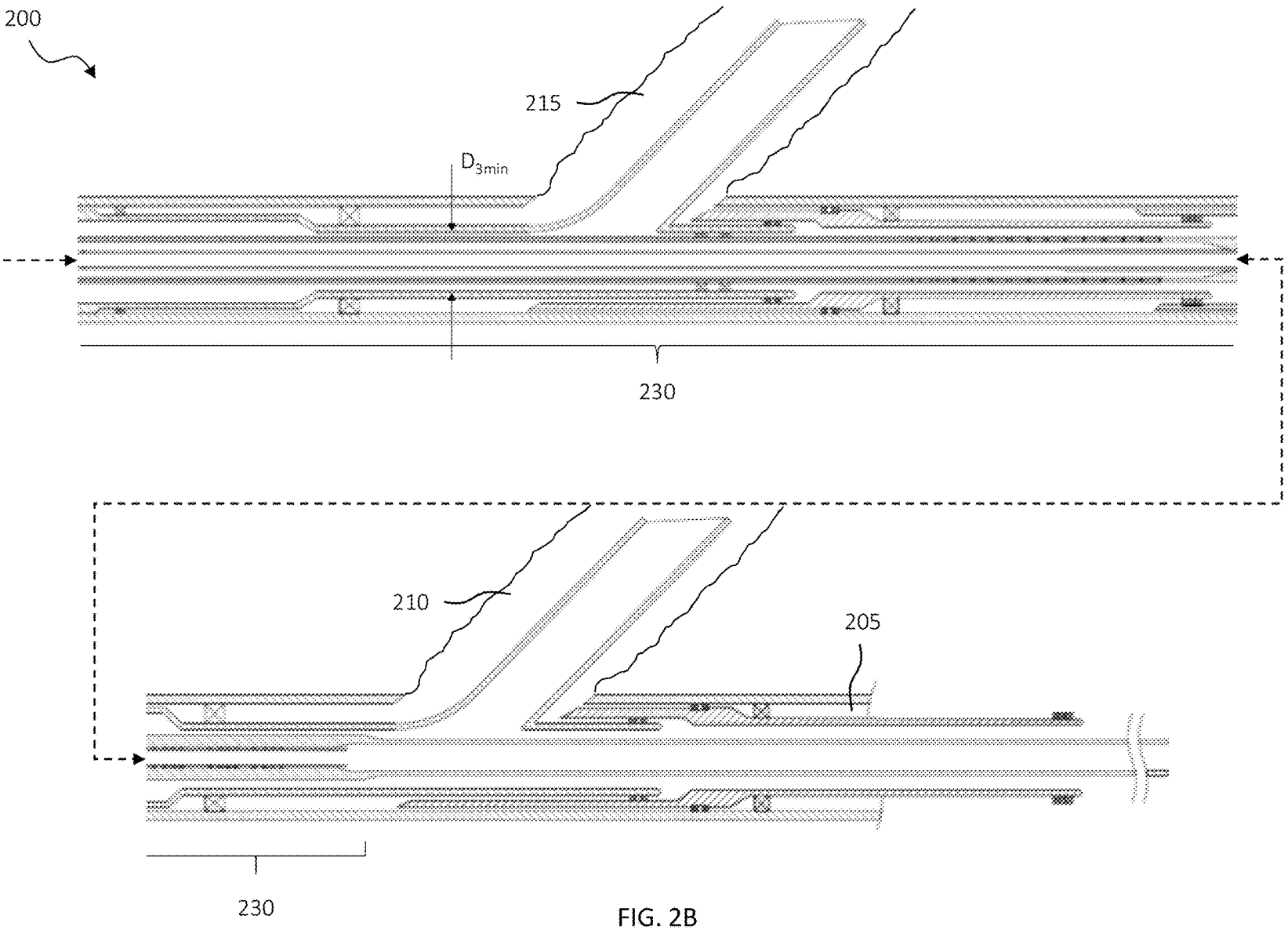

Turning to FIGS. 2A and 2B, illustrated is a multilateral well system 200 including a completion string 220 designed, manufactured, installed and operated according to one or more embodiments of the disclosure. Given the size of the multilateral well system 200, it has been broken up into FIGS. 2A and 2B. FIG. 2A illustrates an upper completion 225 of the completion string 220, whereas FIG. 2B illustrates a lower completion 230 of the completion string 220, as well as a first wellbore 205 (e.g., main wellbore), a second lateral wellbore 210, and a third lateral wellbore 215. In the illustrated embodiment of FIGS. 2A and 2B, the completion string 220 is positioned just uphole of the upper most lateral wellbore, which in the embodiment shown is the third lateral wellbore 215.

In the embodiment illustrated in FIGS. 2A and 2B, the upper completion 225 includes a first tubing string 240, a second tubing string 260 and a third tubing string 280. In the illustrated embodiment, and as will be further evident below, the first tubing string 240 defines a first fluid path 242 operable to receive a first fluid obtained from the first wellbore 205. Similarly, in at least one embodiment, and as will be further evident below, the second tubing string 260 is positioned about the first tubing string 240, such that the first tubing string 240 and the second tubing string 260 create an inner annulus that defines a second fluid path 262 operable to receive a second fluid obtained from the second lateral wellbore 210. Similarly, in at least one embodiment, and as will be further evident below, the third tubing string 280 is positioned about the second tubing string 260, such that the second tubing string 260 and the third tubing string 280 create an outer annulus that defines a third fluid path 282 operable to receive a third fluid obtained from the third lateral wellbore 215. While not specifically required, the first tubing string 240, the second tubing string 260 and the third tubing string 280 may be concentric tubing strings.

In at least one embodiment, the first tubing string 240 ultimately directs the first fluid into a first combined fluid path 295*a*. In at least one embodiment, the second tubing string 260 ultimately directs the second fluid into a second combined fluid path 295*b* (e.g., including the first fluid and the second fluid). In at least one embodiment, the third tubing string 280 ultimately directs the third fluid into a third combined fluid path 295*c* (e.g., including the first fluid, the second fluid and the third fluid). The third combined fluid path 295*c*, as would be expected, couples to the production tubing, for example taking the first, second and third fluids to the surface of the multilateral well system 200.

In the illustrated embodiments, each of the tubing strings 240, 260, 280 may vary in size, attributes and components. Focusing first on the first tubing string 240, it may have two or more different inside diameters (IDs). For example, in the illustrated embodiment of FIG. 2A, the first tubing string 240 includes a minimum inside diameter ($D_{1min}$) and a maximum inside diameter ($D_{1max}$). In at least one embodiment, the minimum inside diameter ($D_{1min}$) is downhole of the maximum inside diameter ($D_{1max}$), and thus as the first tubing string 240 extends uphole it expands from the minimum inside diameter ($D_{1min}$) to the maximum inside diameter ($D_{1max}$). In accordance with one embodiment, the minimum inside diameter ($D_{1min}$) is 2⅞" and the maximum inside diameter ($D_{1max}$) is 3½". In accordance with another embodiment, the minimum inside diameter ($D_{1min}$) is 3½" and the maximum inside diameter ($D_{1max}$) is greater than 3½". Nevertheless, other embodiments may exist wherein other inside diameters are used. It should be noted that while specific diameters have been given for the completion string 220, said specific diameters, unless otherwise required, are given for illustrative purposes only. Accordingly, other diameters outside of those given may be used and remain within the scope of the present disclosure.

In at least one embodiment, a combined fluid tubing 244 extends into the maximum inside diameter ($D_{1max}$), thereby forming an annulus between the combined fluid tubing 244 and the maximum inside diameter ($D_{1max}$). In accordance with this embodiment, the first fluid path 242 also includes the annulus between the maximum inside diameter ($D_{1max}$) and the combined fluid tubing 244. Furthermore, in at least one embodiment, the combined fluid tubing 244 may include a plug 246 proximate a downhole end thereof. The plug 246, in one or more embodiments, is located within a profile in the combined fluid tubing 244 and is operable to force the first fluid out into the annulus between the combined fluid tubing 244 and the maximum inside diameter ($D_{1max}$), through a first flow control device 250 and into the first combined fluid path 295*a*. The plug 246, in at least one embodiment, is a removable plug. Accordingly, if necessary, the plug 246 may be removed from the combined fluid tubing 244, such that an intervention tool could access the first wellbore 205. The combined fluid tubing 244 may additionally include a wireline only guide 248 in certain embodiments.

The first tubing string 240 additionally includes the first flow control device 250 associated with the first fluid path 242. In the illustrated embodiment, the first flow control device 250 couples the first fluid path and the first combined fluid path 295*a*. The first flow control device 250, in at least this embodiment, is configured to regulate the first fluid. For example, the first flow control device 250 could regulate the amount of the first fluid that enters the first combined fluid path 295*a*. In at least one embodiment, the flow control device 250 is a remotely controllable interval control valve (ICV). In yet another embodiment, the flow control device 250 is a manually controllable interval control valve (ICV). In yet another embodiment, the flow control device 250 is a fixed fluid restructure. In yet other embodiments, the flow control device 250 could regulate the type of fluid that enters the first combined fluid path 295*a*. For example, in at least one embodiment, the flow control device 250 is an autonomous flow control device that could autonomously regulate the type of fluid allowed to pass there through (e.g., based upon the viscosity of the fluid or the density of the fluid). Thus, if the flow control device 250 were to encounter undesirable water or gas, the flow control device 250 might stop the flow of the water or gas, and only start the flow back after the first fluid returns to oil.

Focusing now on the second tubing string 260, it may also have two or more different inside diameters (IDs). For example, in the illustrated embodiment of FIG. 2A, the second tubing string 260 includes a minimum inside diameter ($D_{2min}$) and a maximum inside diameter ($D_{2max}$). In at least one embodiment, the minimum inside diameter ($D_{2min}$) is 3½" and the maximum inside diameter ($D_{2max}$) is 4½". Nevertheless, other embodiments may exist wherein other inside diameters are used.

The second tubing string 260 additionally includes a second flow control device 270 associated with the second fluid path 262. In the illustrated embodiment, the second flow control device 270 couples the second fluid path and the second combined fluid path 295*b*. The second flow control device 270, in at least this embodiment, is configured to regulate the second fluid. For example, the second flow control device 270 could regulate the amount of the second fluid that enters the second combined fluid path 295*b*. As will be evident below, the second combined fluid path 295*b* includes the fluid from the first wellbore 205 and from the second lateral wellbore 210. The second flow control device 270 may comprise any of the flow control devices discussed above with regard to the first flow control device 250. In the illustrated embodiment, a second inside diameter of the second flow control device 270 is larger than a first inside diameter of the first flow control device 250.

Focusing now on the third tubing string 280, it may also have two or more different inside diameters (IDs). For example, in the illustrated embodiment of FIG. 2A, the third tubing string 280 includes a minimum inside diameter ($D_{3min}$) and a maximum inside diameter ($D_{3max}$). In at least one embodiment, the minimum inside diameter ($D_{3min}$) is 4½" and the maximum inside diameter ($D_{3max}$) is 9⅝", such is the case if at least a portion of the third tubing string 280 is the casing. Nevertheless, other embodiments may exist wherein other inside diameter are used.

In at least one embodiment, the third tubing string 280 is a portion of the wellbore casing. For example, the third tubing string 280 may be a liner attached to the lower end of an intermediate casing string, or it may be a full string of casing that extends from the surface location to the end of the main wellbore. In other embodiments, third tubing string 280 may be classified as the intermediate casing string; where it is attached to the wellhead at the surface and end just above a production reservoir. After this intermediate casing string is run in the well and cemented, a smaller drill bit (e.g., 8½" diameter) is lowered to the bottom of the intermediate casing string and used to drill the production zone. The production zone may be lined with a 7" liner; a sand control screen assembly maybe run, or the well bore may be left unlined as an open-hole completion.

The third tubing string 280 additionally includes a third flow control device 290 associated with the third fluid path 282. In the illustrated embodiment, the third flow control device 290 couples the third fluid path and the third combined fluid path 295*c*. The third flow control device 290, in at least this embodiment, is configured to regulate the third fluid. For example, the third flow control device 290 could regulate the amount of the third fluid that enters the third combined fluid path 295*c*. As will be evident below, the third combined fluid path 295*c* includes the first fluid from the first wellbore 205, the second fluid from the second lateral wellbore 210, and the third fluid from the third lateral wellbore 215. The third flow control device 290 may comprise any of the flow control devices discussed above with regard to the first flow control device 250 or the second flow control device 270. In the illustrated embodiment, a third inside diameter of the third flow control device 290 is larger than the second inside diameter of the second flow control device 270. In at least one embodiment, the third flow control device 290 is a 5½" valve, the second flow control device 270 is a 3½" valve, and the first flow control device 250 is a 2⅞" valve.

As is illustrated in the embodiment of FIG. 2A, the second flow control device 270 may be positioned between the first flow control device 250 and the third flow control device 290. Additionally, in at least one embodiment, the third flow control device 290 may be positioned uphole of the second flow control device 270. In at least one embodiment, a spacing between the first, second and third flow control devices 250, 270, 290 is no greater than 100 meters. In at least one other embodiment, the spacing between the first, second and third flow control devices 250, 270, 290 is no greater than 50 meters, or in another embodiment no greater than 20 meters. Accordingly, in at least one embodiment the first, second and third flow control devices 250, 270, 290 are stacked flow devices.

It should be noted that while the multilateral well system 200 discussed in FIGS. 2A and 2B is discussed as a production well, other embodiments exist wherein the multilateral well system 200 is an injection well. For example, the multilateral well system 200 could be used to inject fluid (e.g., water) into one or more of the first wellbore 205, the second lateral wellbore 210, and the third lateral wellbore 215. In at least one embodiment, one or more of the first wellbore 205, the second lateral wellbore 210, and the third lateral wellbore 215 could be operated as production wells, and at least one of the first wellbore 205, the second lateral wellbore 210, and the third lateral wellbore 215 is operated as an injection well.

Figure 3A:
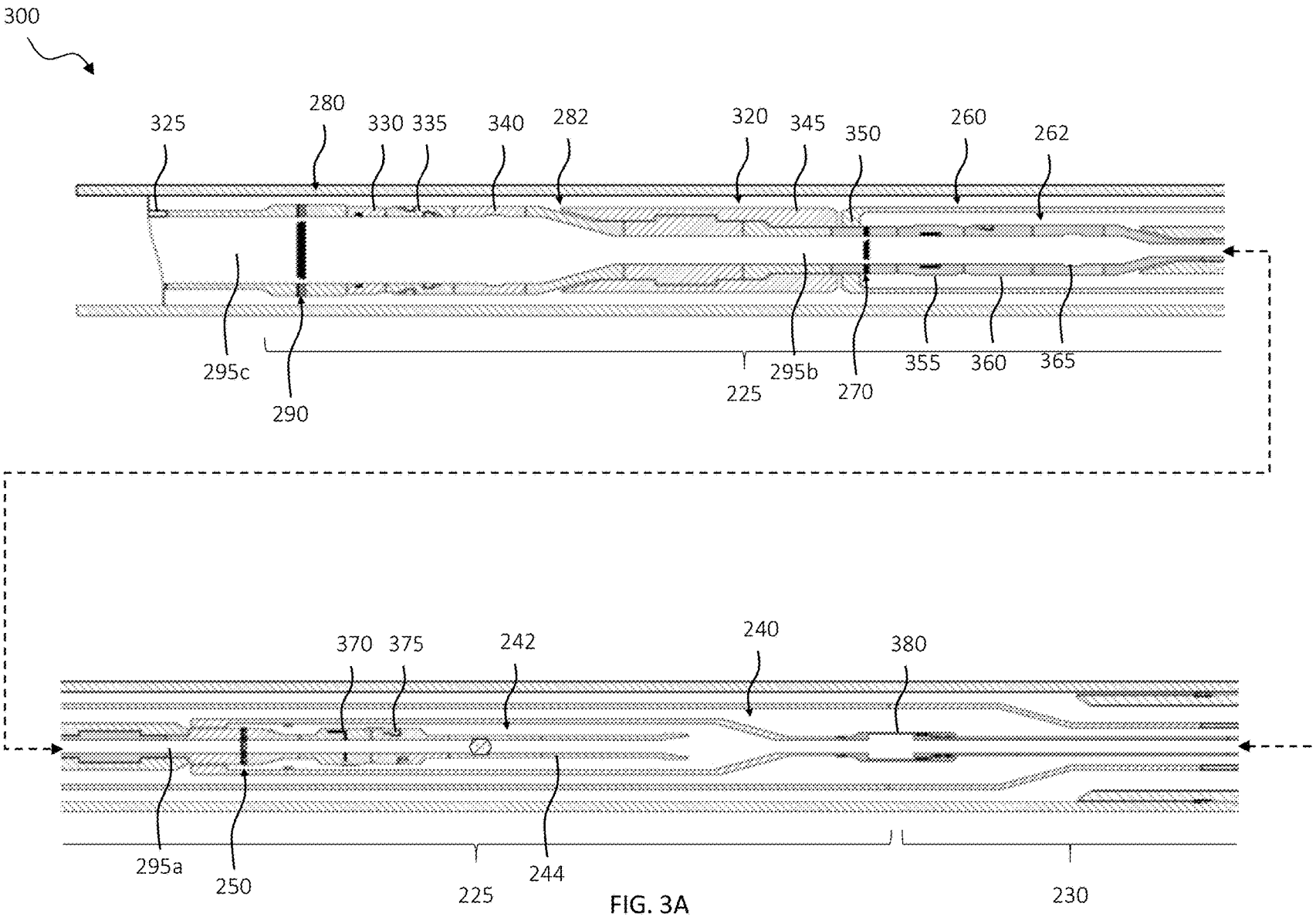
FIGS. 3A and 3B illustrate a multilateral well system including a completion string designed, manufactured, installed and operated according to one or more alternative embodiments of the disclosure.
Figure 3B:
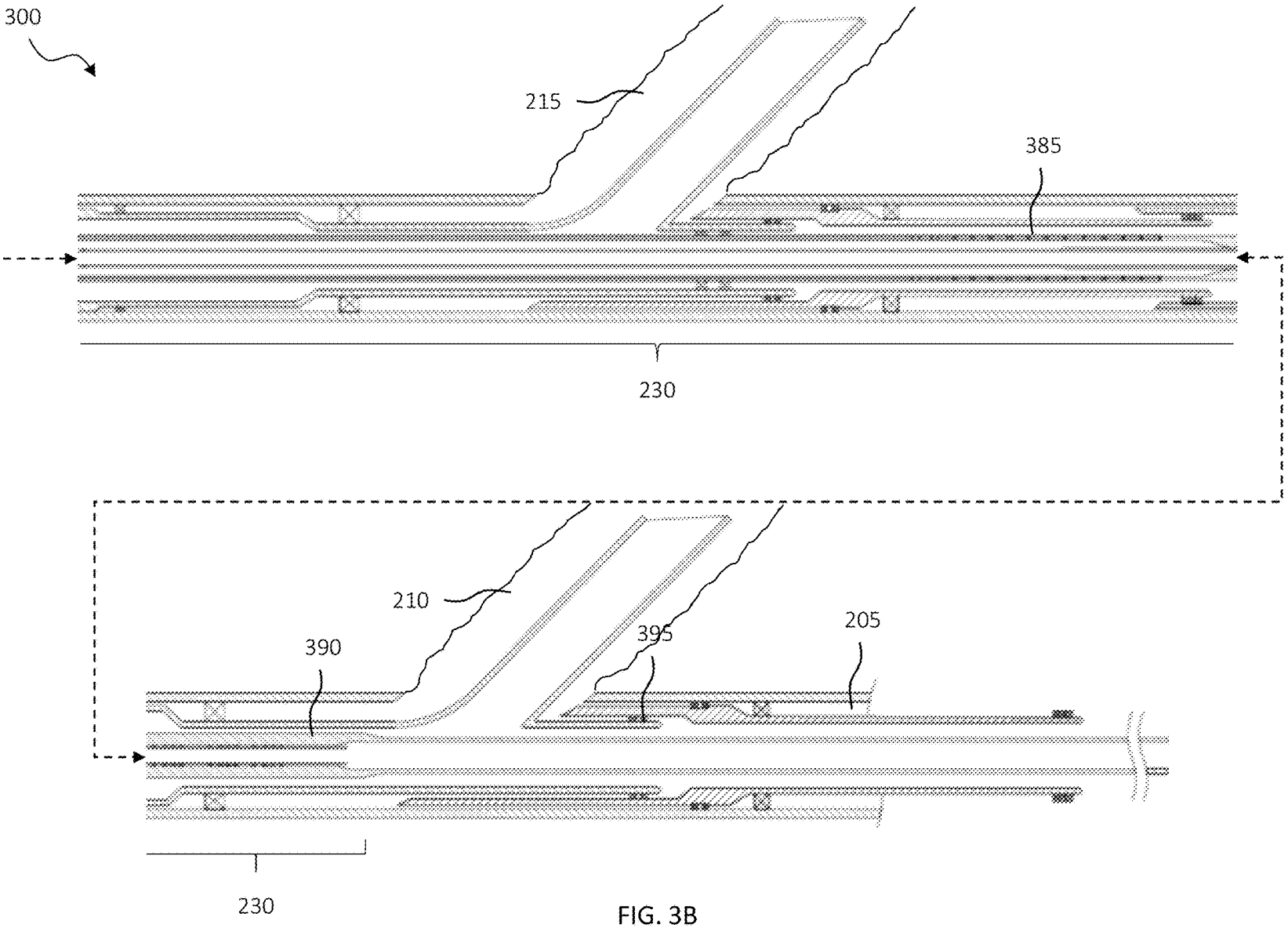

Turning to FIGS. 3A and 3B, illustrated is a multilateral well system 300 including a completion string 320 designed, manufactured, installed and operated according to one or more alternative embodiments of the disclosure. The multilateral well system 300 and the completion string 320 are similar in many respects to the multilateral well system 200 and the completion string 220 of FIGS. 2A and 2B. Accordingly, like reference numbers have been used to indicate similar features. The completion string 320 illustrated in FIGS. 3A and 3B, in one or more embodiments, additionally includes a polished bore receptacle 325. In at least one other embodiment, the completion string 320 additionally includes an internal pressure sensor 330 and internal flow sensor 335. In this embodiment, the internal pressure sensor 330 and internal flow sensor 335 may take measurements of fluid within the second combined tubing 295*b*. The completion string 320 may additionally include a landing nipple profile 340, and a fluted flow deflector 345 (e.g., channels flow in flutes so Control Line/Flat Packs are not subject to erosion). The completion string 320 may additionally include an inductive coupler 350, for connecting power and/or electronics from uphole.

In accordance with one or more embodiments, the completion string 320 may additionally include an internal pressure/flow sensor 355 and external pressure/flow sensor 360. In this embodiment, the internal pressure/flow sensor 355 and external pressure/flow sensor 360 may take measurements of fluid within the first combined tubing 295*a* and the second fluid path 262. The completion string 320 may additionally include a landing nipple profile 365. In accordance with one or more embodiments, the completion string 320 may additionally include an internal pressure/flow sensor 370 and external pressure/flow sensor 375. In this embodiment, the internal pressure/flow sensor 370 and external pressure/flow sensor 375 may take measurements of fluid coming from the first wellbore 205. The completion string 320 may additionally include a travel joint 380 for making up the first, second and third tubing strings 240, 260, 280 in the field (e.g., on the rig floor), and a landing donut (not shown).

The completion string 320 may additionally include multiple perforations 385 in one or more of the first, second and third tubing strings 240, 260, 280. In the illustrated embodiment, the multiple perforations 385 are located in the second tubing string 260. Further to this embodiment, the multiple perforations 385 attempt to reduce the velocity of the fluid entering the second tubing string 260, and thus help with erosion effects. In at least one embodiment, the multiple perforations 385 increase in diameter as they move uphole, again to reduce the erosion effects. Additionally, the multiple perforations 385 may include hardened metal orifices and/or inserts, such as carbide orifices and/or inserts. The completion string 320 may furthermore have another polished bore receptacle 390, as well as another inductive coupling 395.

In one embodiment, a packer (not shown) could be located above the third flow control device 290. For example, in one embodiment the packer would be a "control line set" packer. After the completion string 200 is landed and spaced out, the packer could then be set. Likewise, there may be other devices, sensors, tools, computers, controllers installed above third flow control device 290. This is a good location for other instruments, etc. due to the large amount of area available (e.g., the 5½" OD×8½" ID annulus). Accordingly, it is within the scope of this disclosure to use this area for the placement of one or more, or combination thereof, of the items located below third flow control device 290. In doing so, the control mechanisms for the second flow control device 270 and the first flow control device 250 could be larger (easier to manufacture, tolerance may not have to be as tight, etc.). Only the flow components (tungsten carbide flow trim, pistons to adjust the flow trim, etc.) would need be located in the smaller diameter areas.

A completion string, such as that illustrated in FIGS. 2A through 3B, may be installed using various different methods. For example, the lower completion region 230 could be made up first, followed by the upper completion region 225. In one embodiment, however, a seal assembly landed in a polish bore receptacle (PBR) allows a lower portion of the second tubing string 260 (e.g., the 3½" tubing×4½" tubing string) to be run in the well, and thus within the third tubing string 280 (e.g., the wellbore casing or production tubing in one embodiment). Then the slips may be set on the second tubing string 260. Next a false rotary table may be set up and a lower portion of the first tubing string 240 (e.g., the 2⅞" tubing string) is run inside the second tubing string 260. In one embodiment, the first tubing string 240 could land into the crossover sub that goes directly above the second tubing string 260. A landing collar could be affixed to the first tubing string 240 and landed in the crossover sub. Features such as locking feature could be added to the landing collar or other devices to secure the first tubing string 240 with respect to the second tubing string 260. At this point, the lower completion region 230 would be fully made up.

Once the lower completion region 230 is complete, the upper completion region 225 could be made up and attached to the lower completion region 230. This could include picking up the upper completion region 225 including the first, second and third flow control devices 250, 270, 290 and making it up to the first tubing string 240. Then, with the aid of the travel joint, the first, second and third flow control devices 250, 270, 290 can be lowered to make-up on to the second tubing string 260. The next step would be to lower the upper completion region 225 including the first, second and third flow control devices 250, 270, 290 into the well and install the control line at the upper end of the assembly. These will likely be the only control line connections that will need to be made-up and tested while running the equipment in the well.

Figure 4A:
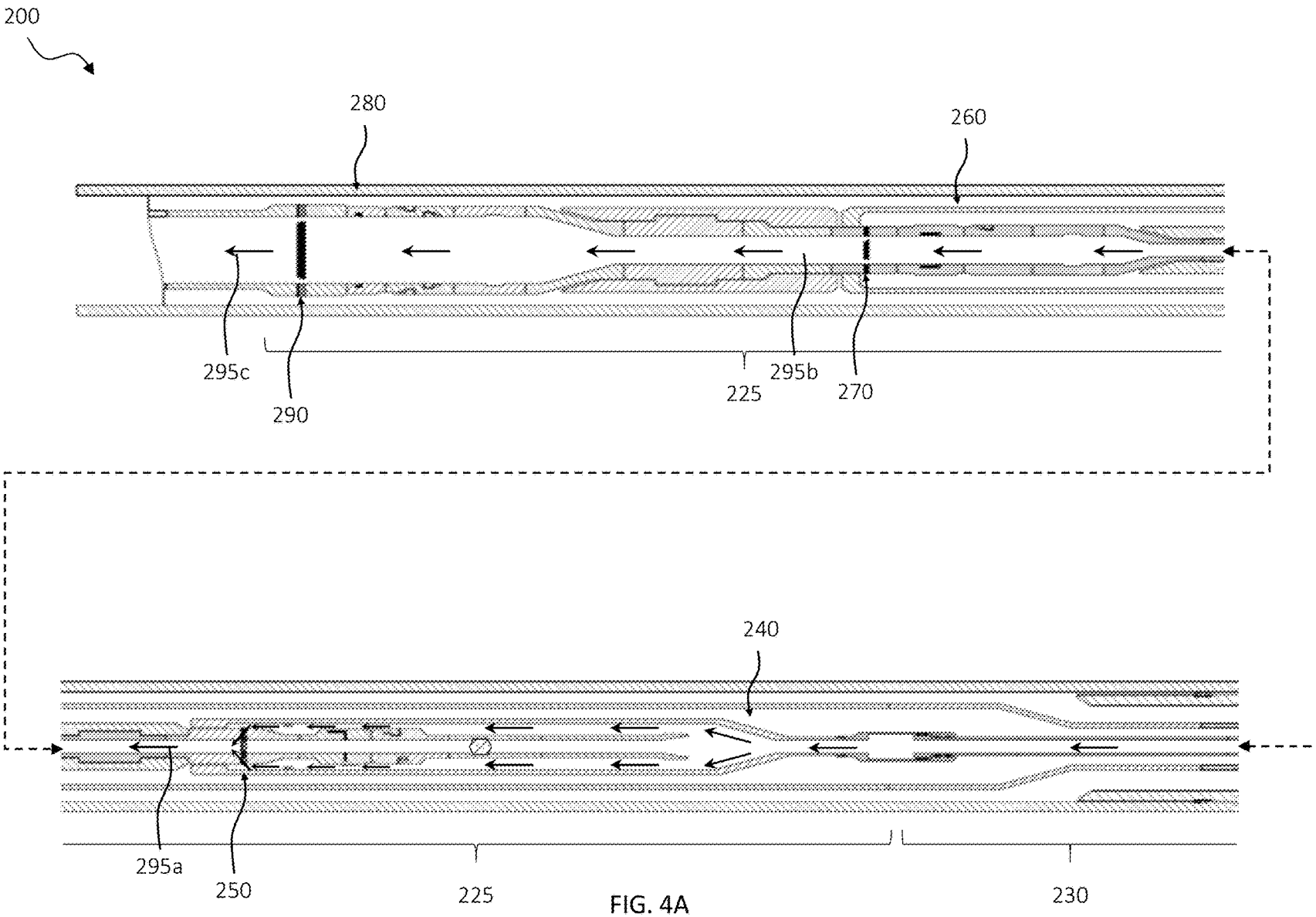
FIGS. 4A and 4B illustrates the fluid flow path for the first wellbore illustrated in FIGS. 2A and 2B.
Figure 4B:
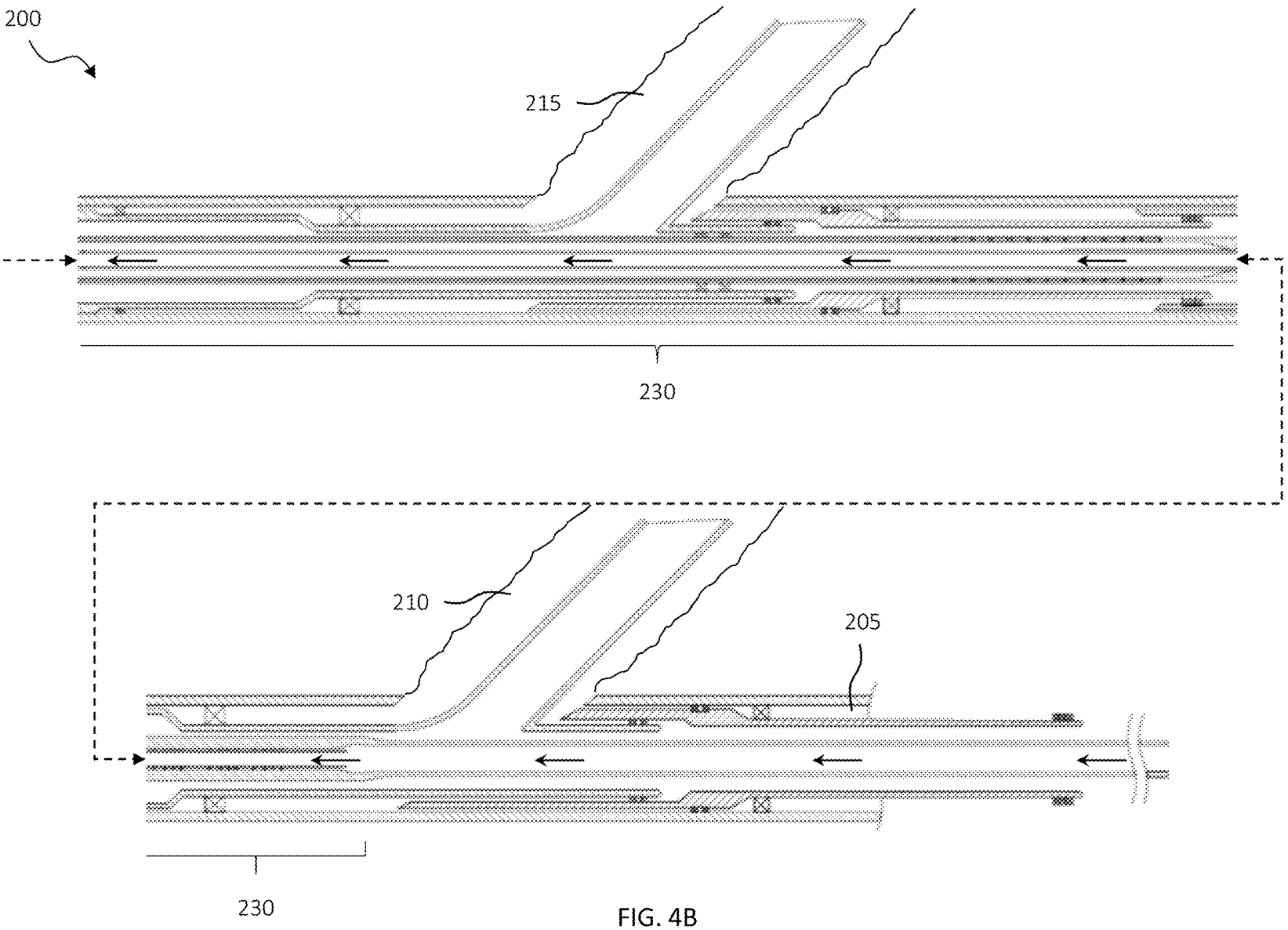
Figure 5A:
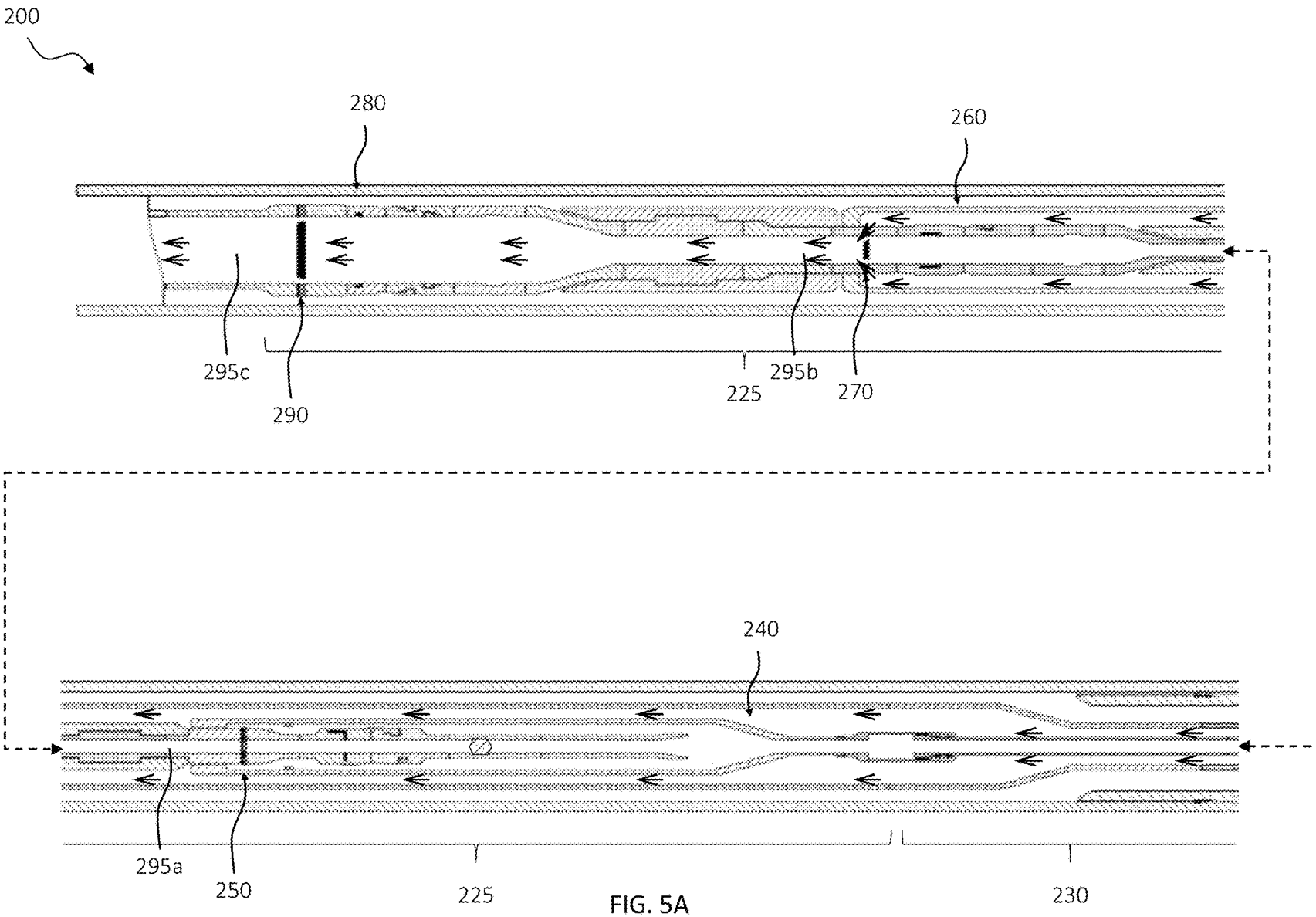
FIGS. 5A and 5B illustrates the fluid flow path for the second lateral wellbore illustrated in FIGS. 2A and 2B.
Figure 5B:
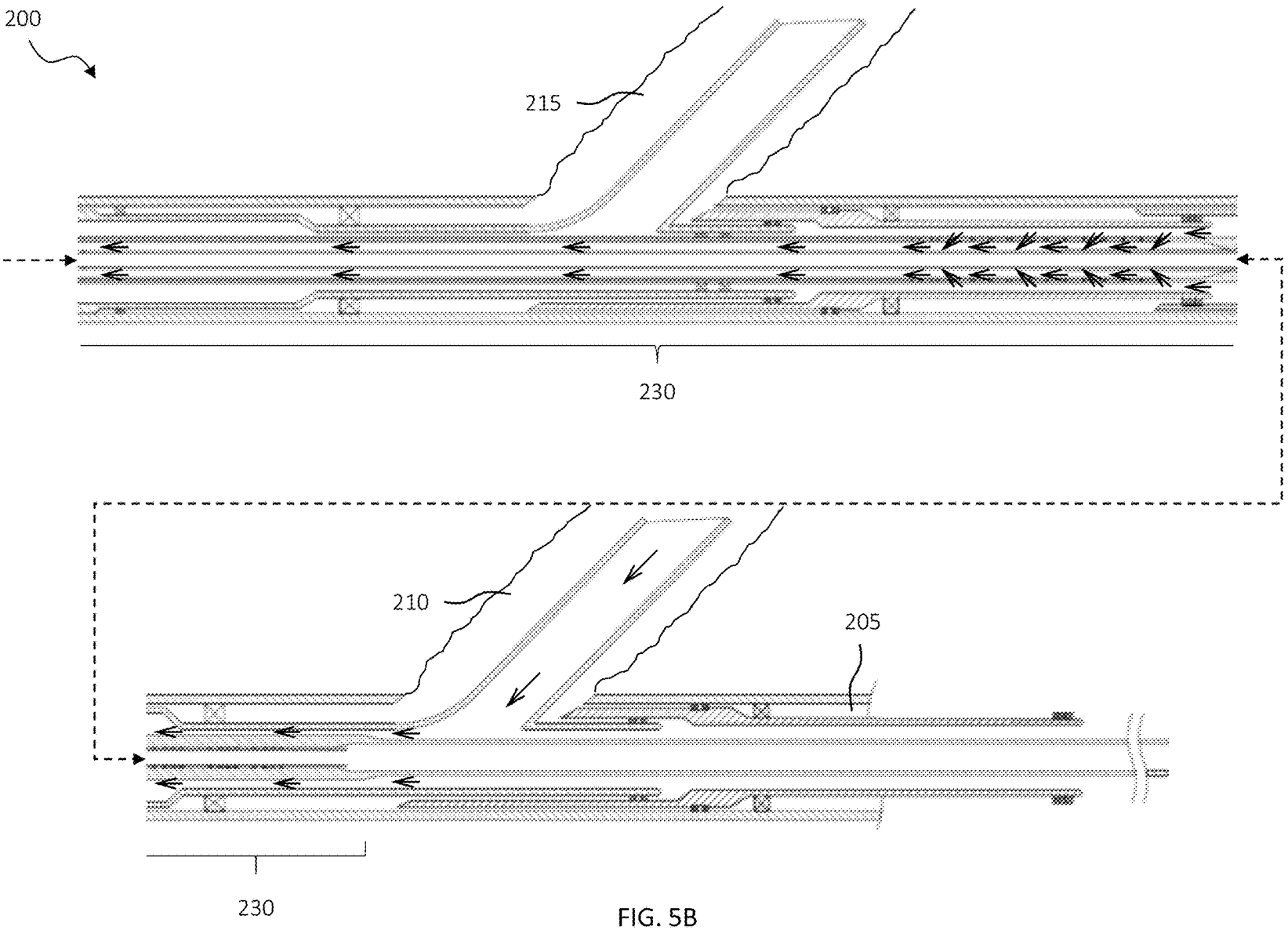
Figure 6A:
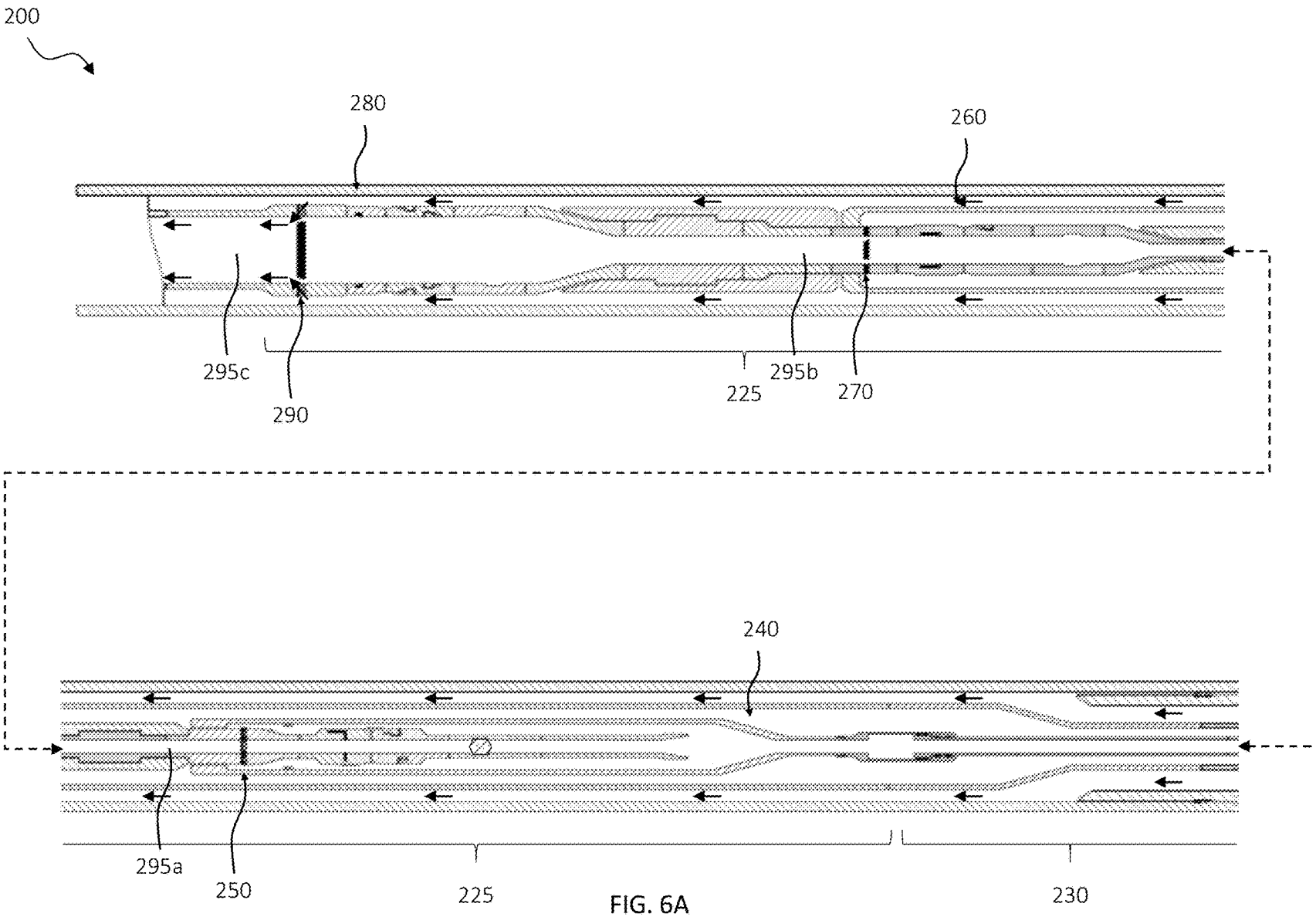
FIGS. 6A and 6B illustrates the fluid flow path for the third lateral wellbore illustrated in FIGS. 2A and 2B.
Figure 6B:
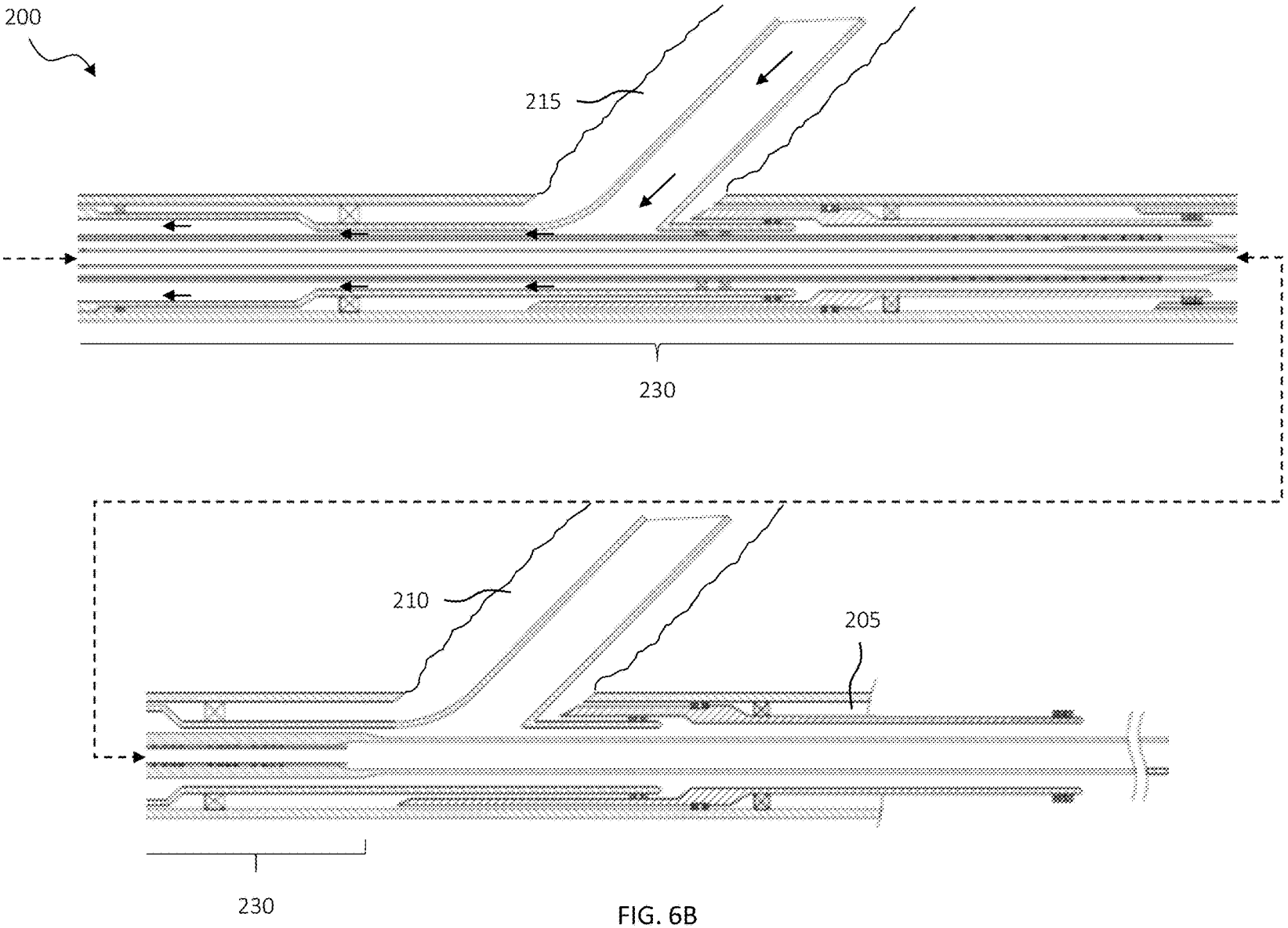
Figure 7A:
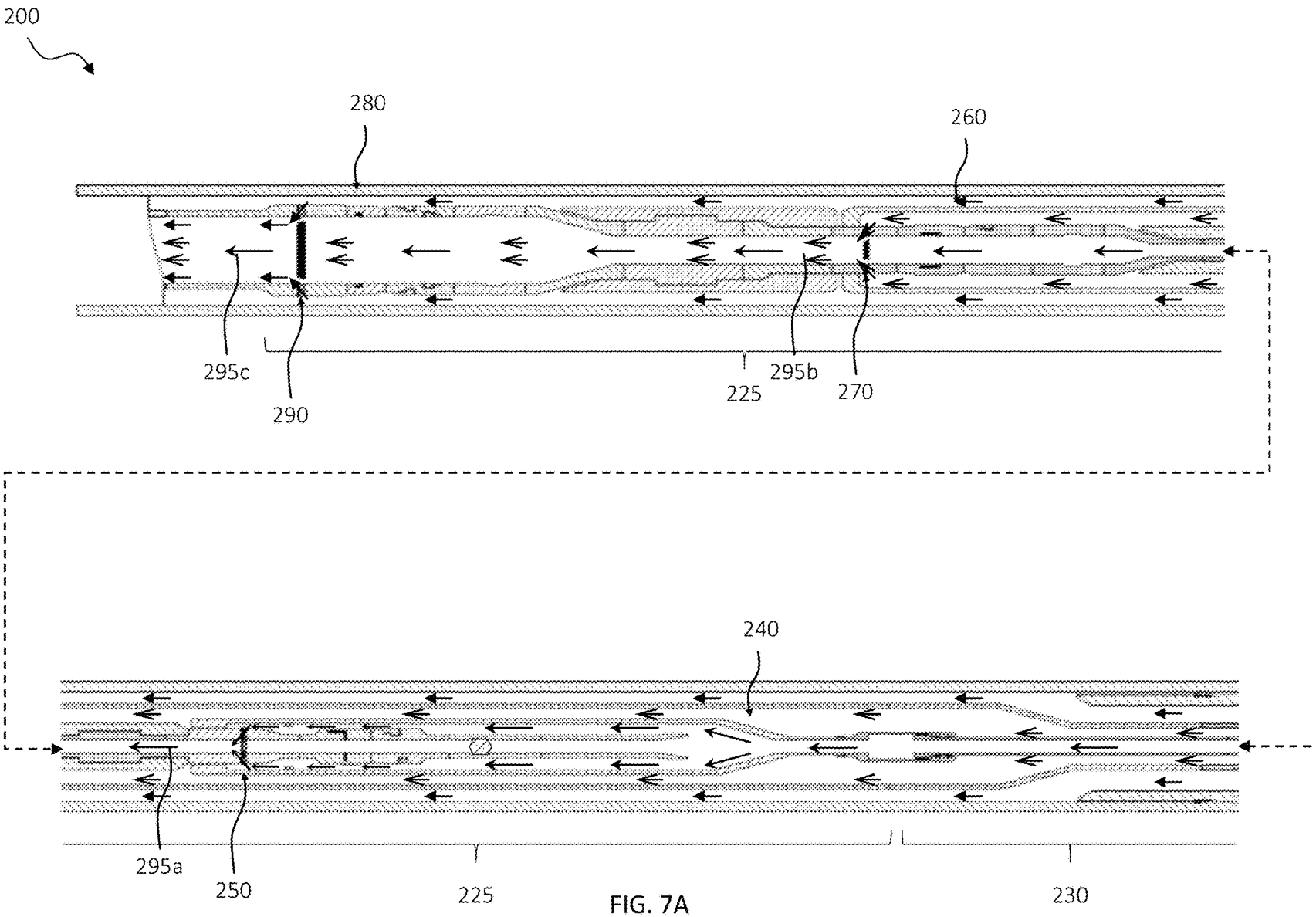
FIGS. 7A and 7B illustrates a combination of the fluid flow paths for the first, second and third lateral wellbores illustrated in FIGS. 2A and 2B.
Figure 7B:
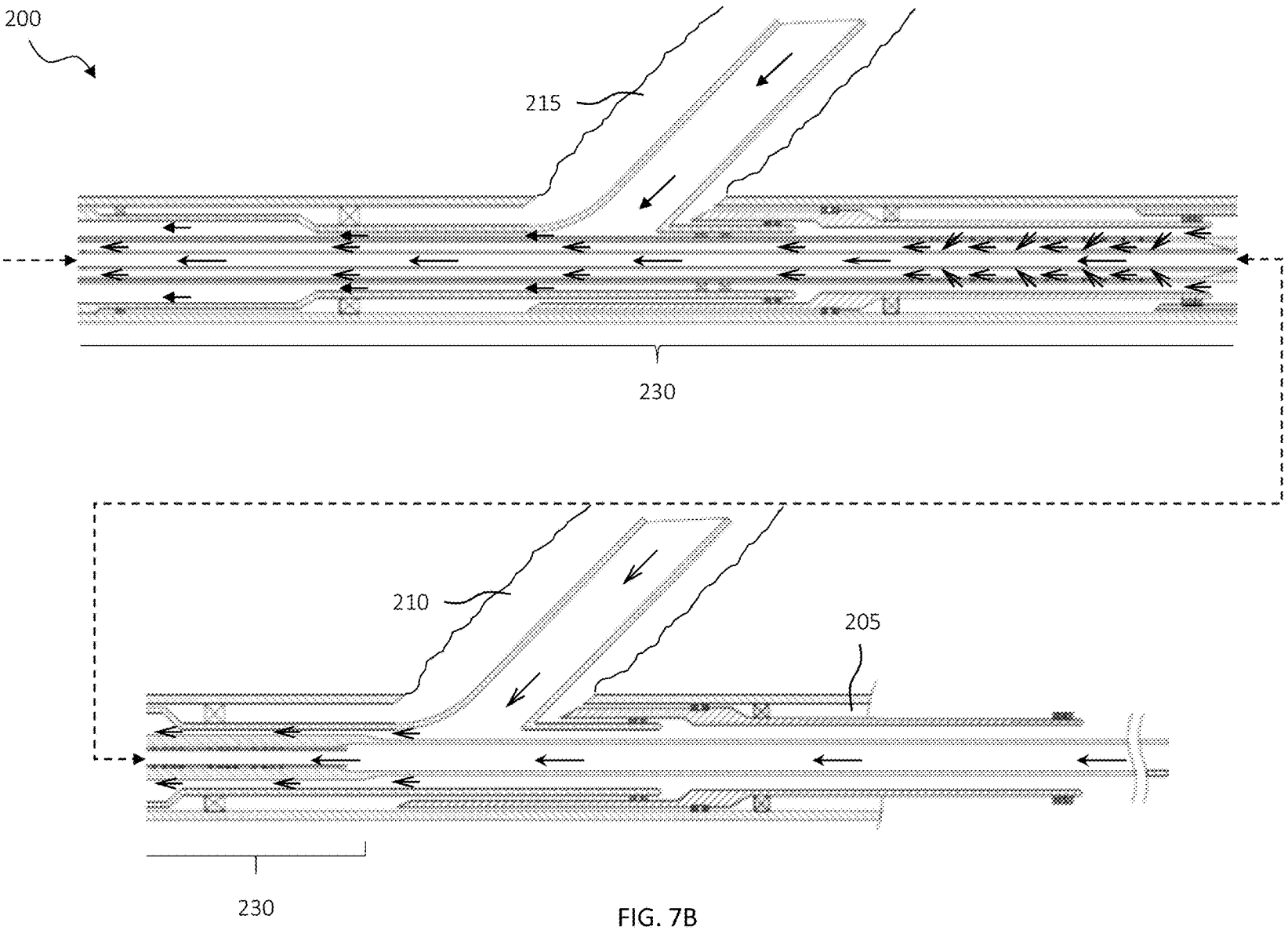

Turning to FIGS. 4A through 7B, illustrated are the various different fluid flow paths for the completion string 200 illustrated in FIGS. 2A and 2B. FIGS. 4A and 4B illustrates the fluid flow path for the first wellbore 205, or in this instance the main wellbore. FIGS. 5A and 5B illustrates the fluid flow path for the second lateral wellbore 210. FIGS. 6A and 6B illustrates the fluid flow path for the third lateral wellbore 215. FIGS. 7A and 7B illustrates the fluid flow path for each of the first wellbore 205, the second lateral wellbore 210 and the third lateral wellbore 215 in combination.

Figure 8A:
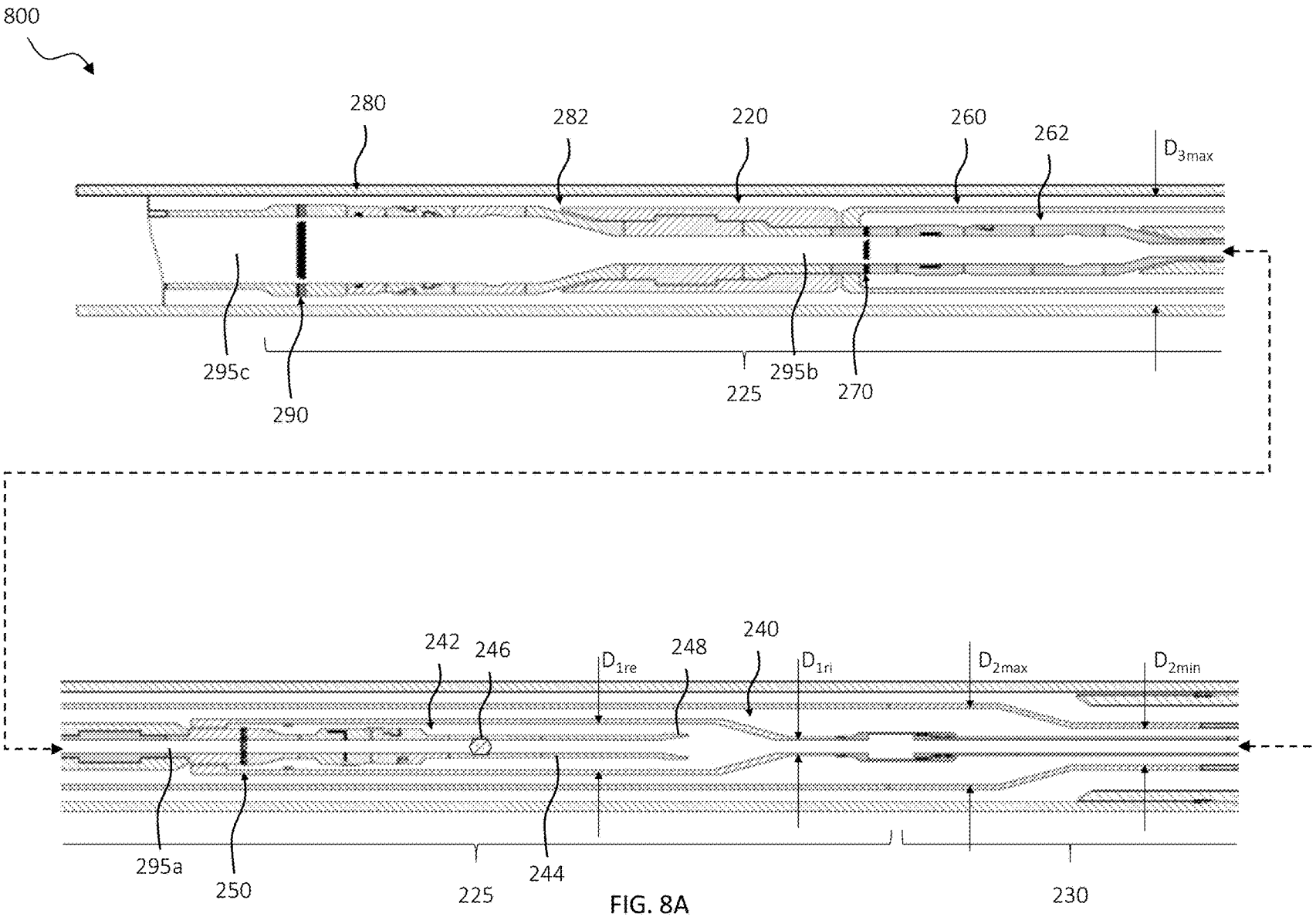
FIGS. 8A and 8B illustrate a multilateral well system including a completion string designed, manufactured, installed and operated according to one or more alternative embodiments of the disclosure.
Figure 8B:
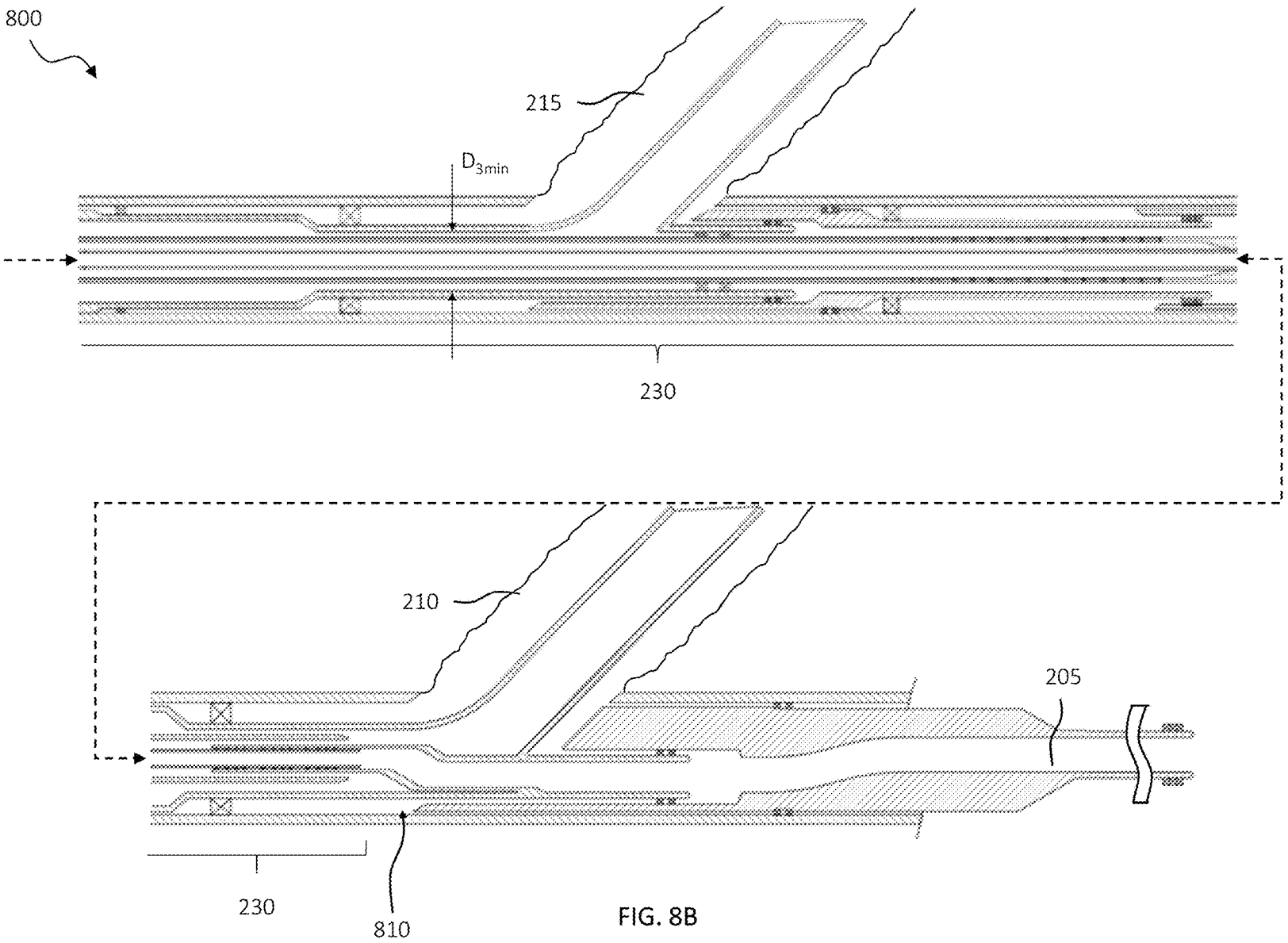

Turning to FIGS. 8A and 8B, illustrated is a completion string 800 designed, manufactured, installed and operated according to an alternative embodiment of the disclosure. The completion string 800 is similar in many respects to the completion string 200 illustrated in FIGS. 2A and 2B. Accordingly, like reference numbers have been used to indicate similar features. However, wherein the completion string 200 employs a MIC junction for the lower junction, the completion string 400 employs an intelligent completion interface (ICI) or threaded leg (TL) junction 810, among other possible choices, for its lower junction. Such a design may be desirable for applications having existing junctions available. It should further be noted that any type of junction, including a level 1 junction (e.g., open hole and open lateral, or with slotted liner without mechanical connection at the junction), level 2 junction (e.g., principal wellbore is cased and cemented, lateral is open hole or drop liner without connection at the junction), level 3 junction (e.g., principal wellbore is cased and cemented, lateral is lined but not cemented, and the lateral wellbore is mechanically joined to the principal wellbore, but the junction is not hydraulically sealed), level 4 junction (e.g., principal wellbore and the lateral wellbore are cased and cemented, where the hydraulic integrity depends on the quality of the cement), a level 5 junction (e.g., the integrity of the junction is accomplished by the completion itself, and the junction can be cemented or not), and a level 6 junction (e.g., the integrity of the junction is accomplished by the casing) may be used with the completion strings designed, manufactured, and operated according to one or more embodiments of the disclosure.

Aspects disclosed herein include:

A. A completion string, the completion string including: 1) a first tubing string, the first tubing string defining a first fluid path operable to receive a first fluid obtained from a first wellbore; 2) a second tubing string positioned about the first tubing string, the first tubing string and the second tubing string creating an inner annulus that defines a second fluid path operable to receive a second fluid obtained from a second lateral wellbore; and 3) a third tubing string positioned about the second tubing string, the second tubing string and the third tubing string defining an outer annulus that defines a third fluid path operable to receive a third fluid obtained from a third lateral wellbore.

B. A multilateral well system, the multilateral well including: 1) a first wellbore located within a subterranean formation; 2) a second lateral wellbore extending from the first wellbore; 3) a third lateral wellbore extending from the first wellbore uphole of the second lateral wellbore; and 4) a completion string positioned within the first wellbore and above a junction between the first wellbore and the third lateral wellbore, the completion string including: a) a first tubing string, the first tubing string defining a first fluid path operable to receive a first fluid obtained from a first wellbore; b) a second tubing string positioned about the first tubing string, the first tubing string and the second tubing string creating an inner annulus that defines a second fluid path operable to receive a second fluid obtained from a second lateral wellbore; and c) a third tubing string positioned about the second tubing string, the second tubing string and the third tubing string defining an outer annulus that defines a third fluid path operable to receive a third fluid obtained from a third lateral wellbore.

C. A method for production from a multilateral well system, the method including: 1) forming a first wellbore within a subterranean formation, a second lateral wellbore extending from the first wellbore, and a third lateral wellbore extending from the first wellbore uphole of the second lateral wellbore; 2) positioning a completion string within the first wellbore and above a junction between the first wellbore and the third lateral wellbore, the completion string including: a) a first tubing string, the first tubing string defining a first fluid path operable to receive a first fluid obtained from a first wellbore; b) a second tubing string positioned about the first tubing string, the first tubing string and the second tubing string creating an inner annulus that defines a second fluid path operable to receive a second fluid obtained from a second lateral wellbore; and c) a third tubing string positioned about the second tubing string, the second tubing string and the third tubing string defining an outer annulus that defines a third fluid path operable to receive a third fluid obtained from a third lateral wellbore; and 3) producing the first fluid through the first tubing string, the second fluid through the second tubing string and the third string through the third tubing string.

Aspects A, B, and C may have one or more of the following additional elements in combination: Element 1: further including a first flow control device associated with the first fluid path and configured to regulate the first fluid, a second flow control device associated with the second fluid path and configured to regulate the second fluid, and a third flow control device associated with the third fluid path and configured to regulate the third fluid. Element 2: wherein the first flow control device has a first inside diameter, the second flow control device has a second inside diameter greater than the first inside diameter, and the third flow control device has a third inside diameter greater than the second inside diameter. Element 3: wherein the second flow control device is positioned between the first flow control device and the third flow control device. Element 4: wherein the third flow control device is positioned uphole of the second flow control device. Element 5: wherein one or more of the first flow control device, second flow control device and third flow control device is a remotely controllable interval control valve (ICV). Element 6: wherein one or more of the first flow control device, second flow control device and third flow control device is a manually controllable interval control valve (ICV). Element 7: wherein one or more of the first flow control device, second flow control device and third flow control device is a fixed fluid restrictor. Element 8: wherein one or more of the first flow control device, second flow control device and third flow control device is an autonomous flow control device configured to autonomously regulate the type of fluid allowed to pass there through. Element 9: wherein the first tubing string, first flow control device, second tubing string, second flow control device, third tubing string and third flow control device form at least a portion of an upper completion region, and further including a lower completion region coupled to a downhole end of the upper completion region, the lower completion region configured to extend to the first wellbore and the second and third lateral wellbores. Element 10: wherein a spacing between the first, second and third flow control devices is no greater than 20 meters. Element 11: further including a first sensor associated with the first flow control device, a second sensor associated with the second flow control device, and a third sensor associated with the third flow control device. Element 12: wherein the first tubing string includes a minimum inside diameter ($D_{1min}$) and a maximum inside diameter ($D_{1max}$), and further wherein a combined fluid tubing extends into the maximum inside diameter ($D_{1max}$), the first fluid path including an annulus between the maximum inside diameter ($D_{1max}$) and the combined fluid tubing. Element 13: wherein the combined fluid tubing includes a removable plug positioned within a profile therein and proximate a downhole end thereof, the plug operable to force the first fluid out into the annulus between the maximum inside diameter ($D_{1max}$) and the combined fluid tubing, and through a first flow control device and into a first combined fluid flow path. Element 14: wherein the first tubing string, the second tubing string and the third tubing string are concentric tubing strings. Element 15: wherein the completion string further includes a first flow control device associated with the first fluid path and configured to regulate the first fluid, a second flow control device associated with the second fluid path and configured to regulate the second fluid, and a third flow control device associated with the third fluid path and configured to regulate the third fluid. Element 16: wherein producing the first fluid through the first tubing includes passing the first fluid through the first fluid control device and into a first combined fluid path, producing the second fluid through the second tubing includes passing the second fluid through the second fluid control device and into a second combined fluid path, the second combined fluid path also including the first fluid, and producing the third fluid through the third tubing includes passing the third fluid through the third fluid control device and into a third combined fluid path, the third combined fluid path also including the first fluid and the second fluid.

Those skilled in the art to which this application relates will appreciate that other and further additions, deletions, substitutions and/or modifications may be made to the described embodiments.

What is claimed is:

1. A completion string, comprising:

a first tubing string, the first tubing string defining a first fluid path operable to receive a first fluid obtained from a first wellbore;

a second tubing string positioned about the first tubing string, the first tubing string and the second tubing string creating an inner annulus that defines a second fluid path operable to receive a second fluid obtained from a second lateral wellbore; and a third tubing string positioned about the second tubing string, the second tubing string and the third tubing string defining an outer annulus that defines a third fluid path operable to receive a third fluid obtained from a third lateral wellbore, further including a first flow control device associated with the first fluid path and configured to regulate the first fluid, a second flow control device associated with the second fluid path and configured to regulate the second fluid, and a third flow control device associated with the third fluid path and configured to regulate the third fluid, wherein the first tubing string, first flow control device, second tubing string, second flow control device, third tubing string and third flow control device form at least a portion of an upper completion region, and further including a lower completion region coupled to a downhole end of the upper completion region, the lower completion region configured to extend to the first wellbore and the second and third lateral wellbores.

2. The completion string as recited in claim 1, wherein the first flow control device has a first inside diameter, the second flow control device has a second inside diameter greater than the first inside diameter, and the third flow control device has a third inside diameter greater than the second inside diameter.

3. The completion string as recited in claim 2, wherein the second flow control device is positioned between the first flow control device and the third flow control device.

4. The completion string as recited in claim 3, wherein the third flow control device is positioned uphole of the second flow control device.

5. The completion string as recited in claim 1, wherein one or more of the first flow control device, second flow control device and third flow control device is a remotely controllable interval control valve (ICV).

6. The completion string as recited in claim 1, wherein one or more of the first flow control device, second flow control device and third flow control device is a manually controllable interval control valve (ICV).

7. The completion string as recited in claim 1, wherein one or more of the first flow control device, second flow control device and third flow control device is a fixed fluid restrictor.

8. The completion string as recited in claim 1, wherein one or more of the first flow control device, second flow control device and third flow control device is an autonomous flow control device configured to autonomously regulate the type of fluid allowed to pass there through.

9. The completion string as recited in claim 1, wherein a spacing between the first, second and third flow control devices is no greater than 20 meters.

10. The completion string as recited in claim 1, further including a first sensor associated with the first flow control device, a second sensor associated with the second flow control device, and a third sensor associated with the third flow control device.

11. The completion string as recited in claim 1, wherein the first tubing string includes a minimum inside diameter ($D_{1min}$) and a maximum inside diameter ($D_{1max}$), and further wherein a combined fluid tubing extends into the maximum inside diameter ($D_{1max}$), the first fluid path including an annulus between the maximum inside diameter ($D_{1max}$) and the combined fluid tubing.

12. The completion string as recited in claim 11, wherein the combined fluid tubing includes a removable plug positioned within a profile therein and proximate a downhole end thereof, the plug operable to force the first fluid out into the annulus between the maximum inside diameter ($D_{1max}$) and the combined fluid tubing, and through a first flow control device and into a first combined fluid flow path.

13. The completion string as recited in claim 1, wherein the first tubing string, the second tubing string and the third tubing string are concentric tubing strings.

14. A multilateral well system, comprising:

a first wellbore located within a subterranean formation;

a second lateral wellbore extending from the first wellbore;

a third lateral wellbore extending from the first wellbore uphole of the second lateral wellbore; and a completion string positioned within the first wellbore and above a junction between the first wellbore and the third lateral wellbore, the completion string including:

a first tubing string, the first tubing string defining a first fluid path operable to receive a first fluid obtained from a first wellbore;

a second tubing string positioned about the first tubing string, the first tubing string and the second tubing string creating an inner annulus that defines a second fluid path operable to receive a second fluid obtained from a second lateral wellbore; and a third tubing string positioned about the second tubing string, the second tubing string and the third tubing string defining an outer annulus that defines a third fluid path operable to receive a third fluid obtained from a third lateral wellbore, further including a first flow control device associated with the first fluid path and configured to regulate the first fluid, a second flow control device associated with the second fluid path and configured to regulate the second fluid, and a third flow control device associated with the third fluid path and configured to regulate the third fluid, wherein the first tubing string, first flow control device, second tubing string, second flow control device, third tubing string and third flow control device form at least a portion of an upper completion region, and further including a lower completion region coupled to a downhole end of the upper completion region, the lower completion region configured to extend to the first wellbore and the second and third lateral wellbores.

15. The multilateral well system as recited in claim 14, wherein the first flow control device has a first inside diameter, the second flow control device has a second inside diameter greater than the first inside diameter, and the third flow control device has a third inside diameter greater than the second inside diameter.

16. The multilateral well system as recited in claim 15, wherein the second flow control device is positioned between the first flow control device and the third flow control device.

17. The multilateral well system as recited in claim 16, wherein the third flow control device is positioned uphole of the second flow control device.

18. The multilateral well system as recited in claim 14, wherein one or more of the first flow control device, second flow control device and third flow control device is a remotely controllable interval control valve (ICV).

19. The multilateral well system as recited in claim 14, wherein one or more of the first flow control device, second flow control device and third flow control device is a manually controllable interval control valve (ICV).

20. The multilateral well system as recited in claim 14, wherein one or more of the first flow control device, second flow control device and third flow control device is a fixed fluid restrictor.

21. The multilateral well system as recited in claim 14, wherein one or more of the first flow control device, second flow control device and third flow control device is an autonomous flow control device configured to autonomously regulate the type of fluid allowed to pass there through.

22. The multilateral well system as recited in claim 14, wherein a spacing between the first, second and third flow control devices is no greater than 20 meters.

23. The multilateral well system as recited in claim 14, further including a first sensor associated with the first flow control device, a second sensor associated with the second flow control device, and a third sensor associated with the third flow control device.

24. The multilateral well system as recited in claim 14, wherein the first tubing string includes a minimum inside diameter ($D_{1min}$) and a maximum inside diameter ($D_{1max}$), and further wherein a combined fluid tubing extends into the maximum inside diameter ($D_{1max}$), the first fluid path including an annulus between the maximum inside diameter ($D_{1max}$) and the combined fluid tubing.

25. The multilateral well system as recited in claim 24, wherein the combined fluid tubing includes a removable plug positioned within a profile therein and proximate a downhole end thereof, the plug operable to force the first fluid out into the annulus between the maximum inside diameter ($D_{1max}$) and the combined fluid tubing, and through a first flow control device and into a first combined fluid flow path.

26. The multilateral well system as recited in claim 14, wherein the first tubing string, the second tubing string and the third tubing string are concentric tubing strings.

27. A method for production from a multilateral well system, comprising:

forming a first wellbore within a subterranean formation, a second lateral wellbore extending from the first wellbore, and a third lateral wellbore extending from the first wellbore uphole of the second lateral wellbore;

positioning a completion string within the first wellbore and above a junction between the first wellbore and the third lateral wellbore, the completion string including:

a first tubing string, the first tubing string defining a first fluid path operable to receive a first fluid obtained from a first wellbore;

a second tubing string positioned about the first tubing string, the first tubing string and the second tubing string creating an inner annulus that defines a second fluid path operable to receive a second fluid obtained from a second lateral wellbore; and a third tubing string positioned about the second tubing string, the second tubing string and the third tubing string defining an outer annulus that defines a third fluid path operable to receive a third fluid obtained from a third lateral wellbore, wherein the completion string further includes a first flow control device associated with the first fluid path and configured to regulate the first fluid, a second flow control device associated with the second fluid path and configured to regulate the second fluid, and a third flow control device associated with the third fluid path and configured to regulate the third fluid; and producing the first fluid through the first tubing string, the second fluid through the second tubing string and the third string through the third tubing string, wherein producing the first fluid through the first tubing includes passing the first fluid through the first fluid control device and into a first combined fluid path, producing the second fluid through the second tubing includes passing the second fluid through the second fluid control device and into a second combined fluid path, the second combined fluid path also including the first fluid, and producing the third fluid through the third tubing includes passing the third fluid through the third fluid control device and into a third combined fluid path, the third combined fluid path also including the first fluid and the second fluid.

* * * * *